US006351927B1

(12) United States Patent
Righele et al.

(10) Patent No.: US 6,351,927 B1
(45) Date of Patent: Mar. 5, 2002

(54) DEVICE FOR PORTIONING FOODSTUFFS, IN PARTICULAR GROUND MEAT, TO BE PACKED IN TRAYS OR THE LIKE

(75) Inventors: Giampietro Righele; Paolo Righele, both of Zane'(IT)

(73) Assignee: Refin S.r.l., Vicenza (IT)

( * ) Notice: Subject to any disclaimer, the term of this patent is extended or adjusted under 35 U.S.C. 154(b) by 0 days.

(21) Appl. No.: 09/484,166

(22) Filed: Jan. 18, 2000

(30) Foreign Application Priority Data

Jan. 18, 1999 (IT) ..... RM99A0031

(51) Int. Cl.[7] ..... B65B 63/00

(52) U.S. Cl. ..... 53/517; 53/435; 53/514; 53/513; 426/513; 426/516; 426/518; 83/932; 83/435.2; 83/271

(58) Field of Search ..... 53/512, 513, 514, 53/515, 516, 517, 250, 251; 83/932, 435.2, 271, 331, 332; 426/417, 480, 513, 506, 520

(56) References Cited

U.S. PATENT DOCUMENTS 4,193,272 A * 3/1980 Bernard ..... 62/320
5,203,141 A * 4/1993 Berciga et al. ..... 53/435
5,349,759 A * 9/1994 Anton et al. ..... 33/524
5,827,561 A * 10/1998 Duve ..... 426/513

* cited by examiner

*Primary Examiner*—Scott A. Smith
*Assistant Examiner*—Thanh Truong
(74) *Attorney, Agent, or Firm*—Browdy and Neimark

(57) ABSTRACT

The invention relates to a portioning device for packaging in containers such as trays a pre-established amount of foodstuff such as ground meat, supplied through an extrusion plate of a grinder, which lays down a mass of ground meat in a continuous strip on a belt conveyor.

The portioning device generates metered portions of ground meat by a cutting element which operates in cooperation with a fixed element located above the belt conveyor.

4 Claims, 2 Drawing Sheets

DEVICE FOR PORTIONING FOODSTUFFS, IN PARTICULAR GROUND MEAT, TO BE PACKED IN TRAYS OR THE LIKE

BACKGROUND OF THE INVENTION

1. Technical Field of the Invention

The present invention relates to a portioning device which generates metered portions of meat ground by a grinder by means of a shear-like cutting element operating above a single belt conveyor.

More specifically, the invention relates to the constructional improvement for the metered filling of trays or similar containers to be conveyed to a packaging unit.

2. Prior Art

A grinder which generates in a continuously ground meat to be conveyed to the packaging process is well-known to the skilled in the art.

Higher and higher speed and reliability requirements are required for foodstuff packaging in industrial production, in particular in the meat food industry. Namely, foodstuffs, when outputted from a processing machine such as a meat grinder, must be quickly portioned in order to be collected in pre-established amounts in a completely mechanized way in containers or tray-like packaging or plastic sheet as well.

Today, production speed tends to increase in every operational stage in order to obtain a higher number per minute of packed products to be conveyed to the distribution chains. The productivity of operational processes and the output of operational equipment and/or devices heavily affect successful competition on the market for the allotment of industrial supplies. As a consequence, manufacturers of industrial goods strive to achieve better and better performances for their machines and equipment, at the lowest possible cost and with reasonable reliability. Research on performance improvement must take the road of sharp improvement of all components and devices which make up the production line and all related aspects. Thus, the research on improved construction for operational devices and/or means, tends to obtain an overall production line of improved quality, that is of higher technological content joined with constructional simplifications of some importance. The operation being the same, constructional simplifications applied to operational means in practice eliminate most of the drawbacks which may arise during the manufacturing process. Impediments to the manufacturing process, even if reduced to a slight impact in percentage, become of great importance because of the delay they cause during the subsequent stages of the production cycle, due to the high production rate of present manufacturing processes.

There are known portioning devices based on the use of two flat belt conveyors, one subsequent to the other, which convey the ground meat supplied through the extrusion plate of a grinder. This kind of application is based on the use of a portioning device operated between the two conveyors in order to generate measured portions of ground meat. Incidentally, the cutting blade for shearing said portions of meat is located in the space between the two belt conveyors. Of course shearing, in order to generate the measured portions of ground meat in the known applications, cannot take place along the belt conveyor, because the cutting blade would cut into the conveyor itself. The known application illustrated above causes some drawbacks which make its application limited.

The application, in fact, presents some drawbacks which make its manufacturing and assembling stages difficult and, as a consequence, implies high manufacturing costs, together with a not-so rational operation from the functional view point. Such drawbacks consist mainly of the presence of two belt conveyors which cause a double motion and are manufactured using several mechanical elements joined and fastened one to the other, with high overall costs. Moreover, additional elements are needed for their logical operational coordination; all this helps to raise the final cost of such processing equipment, and to cause management problems of relative importance to the operators assigned to the control of the manufacturing process.

OBJECT AND BRIEF SUMMARY OF THE INVENTION

Having in mind what set forth above, the primary objective of the present invention is to provide a single belt conveyor for conveying the ground meat from the extrusion plate of the grinder to filling the trays and, moreover, to simplify the conveyor itself in its construction. One aim, which also makes up a primary objective of the present invention, is to portion the product in a safe way on the belt itself by operating a shear-like cutting blade.

Another aim of the present invention is that the portioning device be free from drawbacks and allow good visibility along the path of the strip of ground meat to be packed in the trays.

A further aim of the present invention is that the portioning device will provide a simple structure, easy to implement, operating safely and effectively, and moreover of relatively low price.

Such objectives and such aims are all attained by the portioning device of the present invention, which provides a flat fixed element located crosswise above the flat belt conveyor and a cutting element for cutting the ground meat strip into portions in coordinated cooperation. Said flat fixed element comprises a short angled initial section for lifting the meat strip and a short flat terminal section provided with a crosswise slot for the portioning cut of ground meat for filling the trays.

According to a practical embodiment the portioning device of the present invention is located in proximity to the end of the belt conveyor on the side of the trays' filling, and operates the cutting element when the belt conveyor is stationary.

BRIEF DESCRIPTION OF THE DRAWINGS

With reference to what set forth above, the following description, shown simply as a non-limiting example, will serve the purpose of illustrating the invention in object with reference to the figures of the annexed drawings wherein.

DETAILED DESCRIPTION OF THE PREFERRED EMBODIMENT(S) OF THE INVENTION

Figure 1:
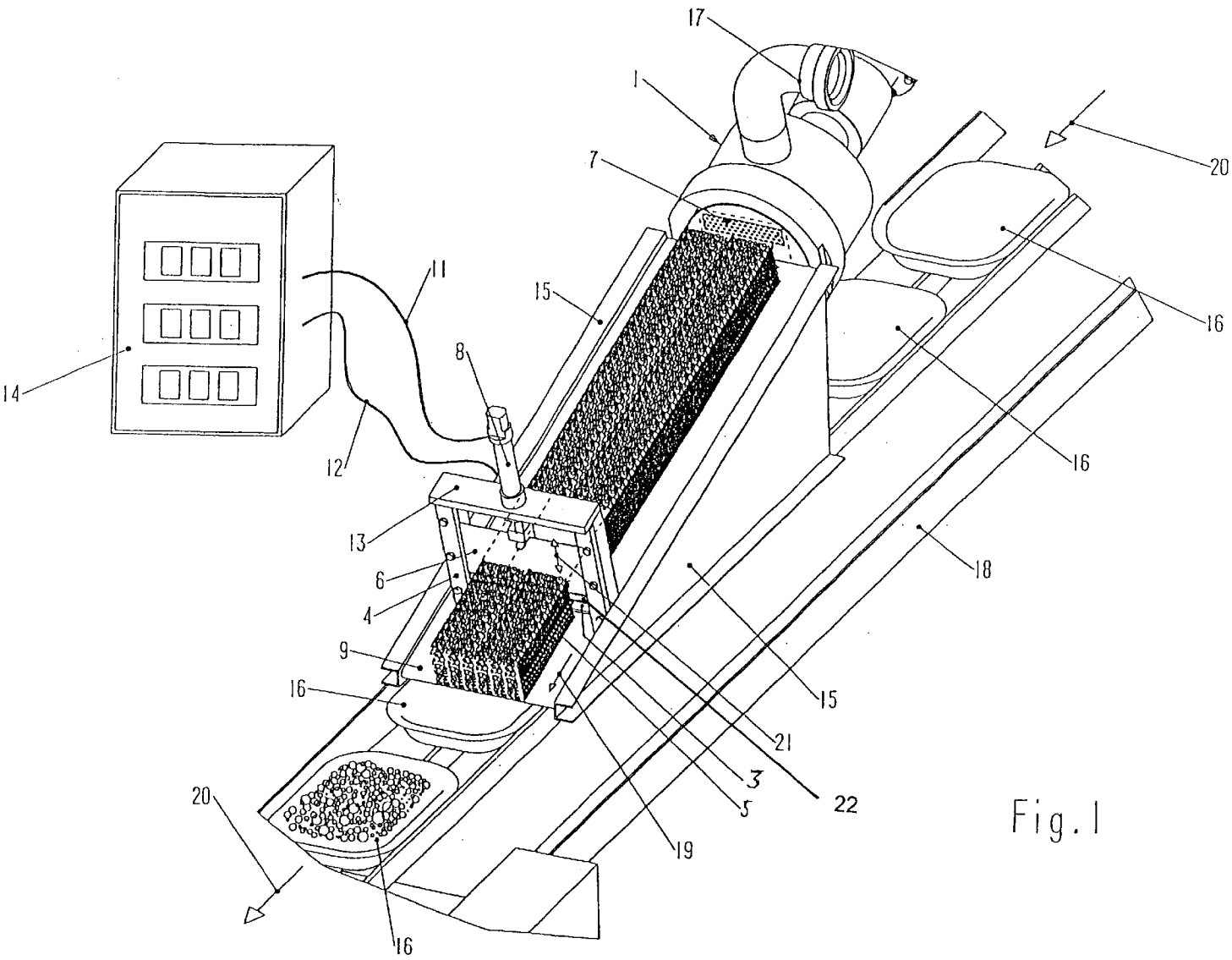
FIG. 1 is a view in axonometric perspective of the portioning device of the present invention showing the cutting instant of the cutting blade operated over the belt conveyor for generating metered portions of ground meat which will be placed in the packing tray, and, moreover, schematically shows the extrusion plate of the grinder which supplies the ground meat, arranging it continuously in a string of parallelepipedal shape on the belt conveyor itself.
Figure 2:
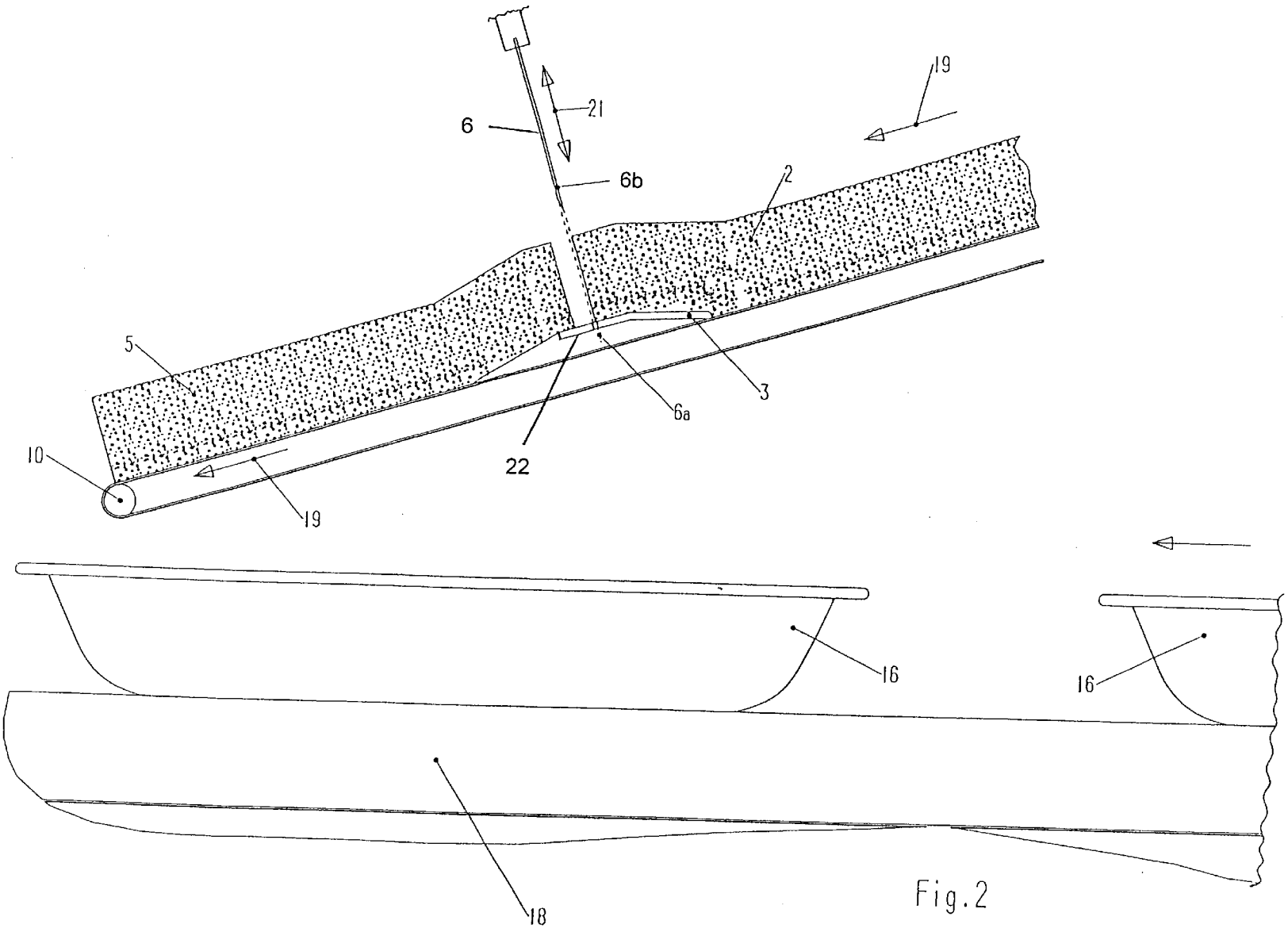
FIG. 2 is a schematic side view showing the transverse fixed flat element which lifts the ground meat strip from the belt conveyor in the cutting area, and, moreover, schematically shows the overhanging cutting blade with the underlying trays.

The machines and/or devices operating in reciprocal cooperation with the portioning device of the present invention will not be illustrated or described in their operation, as they are already known, and anyway they don't fall into the scope of the present invention.

For the sake of clarity of the assembly, in the figures same or equivalent parts are indicated by identical reference fonts.

The operation of the portioning device of the present invention will be hereinafter disclosed with reference to the figures of the annexed drawings.

A block 1 of a grinder supplies by means of an extrusion plate 7 the ground meat, which usually is thrust-fed through tube 17, the whole as it is well-known to the skilled in the art. Ground meat is laid in a continuous way on a flat belt conveyor 9, and on said conveyor 9 it is shaped into a parallelepipedal strip 2 moving along direction 19 due to the motion of the conveyor 9 itself, which revolves around a roller 10. The revolving rollers, the flat conveyor and its relative drive unit (not illustrated) are advantageously supported by and assembled on a mount 15. The strip of ground meat proceeding along conveyor 9 passes underneath a cutting frame 13 with a fixed structure provided with uprights 4 fastened to the mount 15. The parallelepipedal strip mass 2 of ground meat is lifted during its passage under the frame 13, spacing it out from conveyor 9 by means of a transverse element 3 engaged on frame 13 advantageously profiled with an initial angled section grazing the conveyor at a beginning end, followed by a flat section on which a slot 22 has been cut in order to allow the passage therethrough of the cutting blade 6.

Incidentally, the amount of the above-mentioned lifting is such as to ensures the lack of contact between the blade 6 and the conveyor 9 during all cutting steps.

At the instant when the length of the meat strip 2 which has passed under the cutting blade 6 matches the metered portion 5 to be packed in the tray 16, a control board 14, programmed at pre-set values, generates a control which operates, preferably by means of a pneumatic operation, an actuator 8 which moves the cutting blade 6 from position 6*b* to position 6*a* and brings it back to the starting position 6 according to an alternated up and down motion 21.

During the cutting operation 21 the flat conveyor 9 is stopped while the actuator 8 is operated by the control fluid operating through tubes 11 and 12.

At the end of the cutting operation the conveyor 9 starts moving again along a direction 19 in order to place, in adjusted coordinated motions, the metered portion of meat 5 in the tray 16 which proceeds along a direction 20 by means of a plane conveyor provided with a supporting structure 18.

While the metered portion 5 of ground meat is laid down in the tray 16, the strip 2 of ground meat proceeds along direction 19 as far as is needed in order to make up again the measured portion which undergoes the new subsequent cutting operation by the blade 6. The operational cycle of the portioning device illustrated above is renewed automatically in the presence of a continuous supply of ground meat extruded from the grinder 1, in order to fill a plurality of trays 16 to be sent to the packaging process.

The portioning device designed as illustrated above is susceptible of modifications and variations, all of them falling within the scope of the invention's concept.

Furthermore, all details can be replaced by technically equivalent ones.

It is also obvious that the materials used, as well as the shapes and dimensions, can be of any kind, depending on one's needs, without being excluded from the protective scope of the claims illustrated hereinafter.

What is claimed is:

1. A portioning device for packaging in containers such as trays a pre-established amount of foodstuff such as ground meat, supplied by an extrusion plate (7) of a grinder (1), the portioning device laying a mass of ground meat delivered evenly as a strip (2) onto a belt conveyor (9) which proceeds from an area underlying said extrusion plate (7) to a filling area for said containers (16), said portioning device comprising:

an element (3) located and fixed crosswise above said belt conveyor (9) to lift a length of the strip from the conveyor (9);

and a cutting element (6) located on said fixed element (3), which operates at pre-set instants to generate metered portions (5) of meat for direct unloading in said containers;

said fixed element (3) being provided with an initial angled section changing from a grazing crosswise position with respect to said conveyor (9) to a lifted position spaced from the conveyor (9);

said angled section proceeding with a flat terminal section wherein a crosswise slot (22) is cut for allowing passage therethrough of said cutting element, said flat terminal section supporting and spacing out the strip (2) from the conveyor (9).

2. The portioning device according to claim 1, wherein said fixed element (3) and said cutting element (6) are positioned in proximity to an end roller (10) of said belt conveyor (9).

3. The portioning device according to claim 1, wherein the portioning operation by said cutting element (6) is carried out when said belt conveyor (9) is stationary.

4. The portioning device according to claim 1, where the strip (2) has a parallelepipedal shape.

* * * * *